US005178207A

United States Patent [19]

Bergqvist et al.

[11] Patent Number: 5,178,207

[45] Date of Patent: Jan. 12, 1993

[54] PLATE HEAT EXCHANGER WITH LEAKAGE DETECTOR

[75] Inventors: Jan-Ove Bergqvist, Malmö; Ralf Blomgren, Skanör, both of Sweden

[73] Assignee: Alfa-Laval Thermal AB, Lund, Sweden

[21] Appl. No.: 768,542

[22] PCT Filed: May 15, 1991

[86] PCT No.: PCT/SE91/00344

§ 371 Date: Sep. 26, 1991

§ 102(e) Date: Sep. 26, 1991

[87] PCT Pub. No.: WO91/18253

PCT Pub. Date: Nov. 28, 1991

[30] Foreign Application Priority Data

May 16, 1990 [SE] Sweden ..... 9001762-5

[51] Int. Cl.[5] ..... F28F 3/10; F28F 11/00

[52] U.S. Cl. ..... 165/70; 165/167

[58] Field of Search ..... 165/166, 167, 70, 11.1

[56] References Cited

U.S. PATENT DOCUMENTS

| | | | |
|---|---|---|---|
| 2,221,937 | 11/1940 | Astle | 165/70 |
| 2,582,871 | 1/1952 | Kintner | 165/70 |
| 3,610,331 | 10/1971 | Schreiber | 165/166 |
| 4,249,597 | 2/1981 | Carey | 165/166 |
| 4,678,027 | 7/1987 | Shirey et al. | 165/70 |

FOREIGN PATENT DOCUMENTS

| | | | |
|---|---|---|---|
| 2713977 | 10/1978 | Fed. Rep. of Germany | 165/167 |
| 168266 | 8/1959 | Sweden . | |
| 8200708 | 8/1983 | Sweden . | |
| 8606463 | 11/1986 | World Int. Prop. O. . | |
| 8803253 | 5/1988 | World Int. Prop. O. . | |

*Primary Examiner*—John Rivell
*Assistant Examiner*—L. R. Leo
*Attorney, Agent, or Firm*—Davis Hoxie Faithfull & Hapgood

[57] ABSTRACT

In a plate heat exchanger a stack of double-wall elements (23–26) is included, which between themselves form flow passages (32–34), and each one of which comprises two heat exchange plates, each having a heat exchange portion and a sealing portion surrounding the same and via said portions abutting directly against corresponding portions of the other heat exchange plate. Sealing members (28–31) abut sealingly against adjacent double-wall elements (23–26) along the sealing portions and delimit the flow passages (32–34). Joining means press the double-wall elements against each other. To enable a quick indication of a possible leakage through a heat exchange plate at least one channel (40, 41) is arranged between the plates in each double-wall element. The channel (40, 41) is designed between opposite parts of sealing portions of the respective heat exchange plates and extends across the latter. The channel (40, 41) connects an area inside the sealing portions with the surrounding (35) of the plate heat exchanger. The rest of the sealing portions abuts directly against each other.

4 Claims, 2 Drawing Sheets

PLATE HEAT EXCHANGER WITH LEAKAGE DETECTOR

Figure 1:
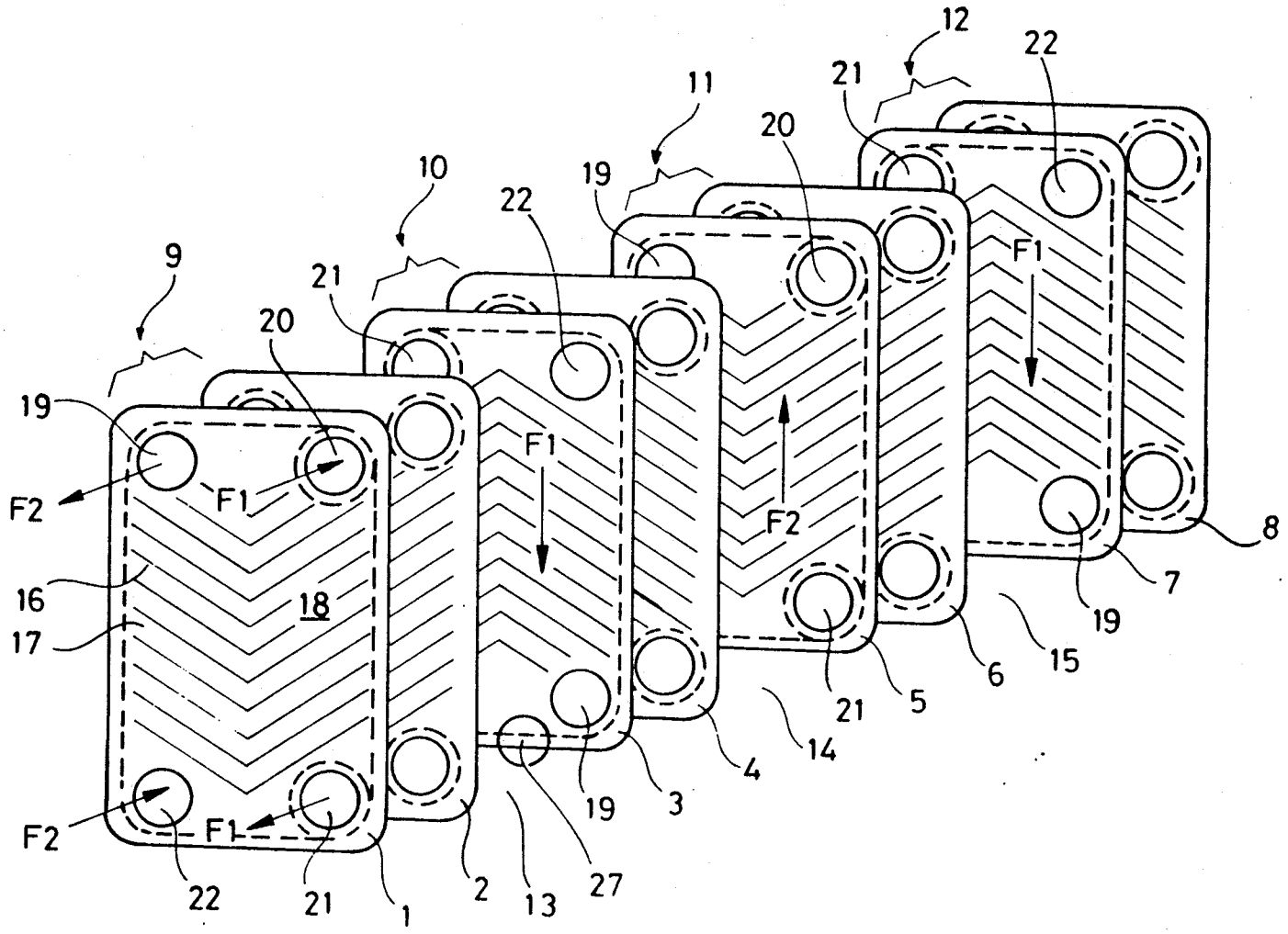

The present invention concerns a plate heat exchanger for exchanging of heat from one fluid to another, comprising a stack of double-wall elements, which between themselves form flow passages for the two fluids and each one of which comprises two thin heat exchange plates, each having a central heat exchange portion and a sealing portion surrounding the same and abutting directly against corresponding portions of the other heat exchange plates. The plate heat exchanger further comprises a sealing member, which abuts sealingly against adjacent double-wall elements along the sealing portions of their respective heat exchange plates and delimits a flow passage between the double-wall elements and joining means arranged to press the double-wall elements directly against each other in the areas for the heat exchange portions of the respective plates, and indirectly against each other via the sealing members in the areas of the sealing portions of the heat exchange plates.

A plate heat exchanger of this kind is shown in WO 88/03253 and is useful for heat exchange between fluids, which must not be contaminated by each other. The stack of double-wall elements are joined together by means, which press the double-wall elements partly directly against each other in the areas for the heat exchange portions of the respective plates, partly indirectly against each other via the said sealing member in the areas of the sealing portions of the plates. As a result of this pressing of the double-wall elements together a large heat exchange contact surface is created between the heat exchange plates in each one of the double-wall elements, which means good heat. exchange efficiency of the heat exchanger. At the same time the system is rendered more secure against liquid leakage through one heat exchange plate immediately resulting in one heat exchange fluid mixing with the other.

Upon a possible leakage through a heat exchange plate in a plate heat exchanger of this kind the leaking fluid must have the opportunity to flow out of the plate heat exchanger in order to enable the leakage to be observed. In addition, a desire has been raised that a leakage has to be observed within a certain time period after the leakage has occurred.

In practice it has shown to be hard to satisfy the raised desires about a quick discovery of a leakage. The better contact there is achieved between the two heat exchange plates in each double-wall element the harder it seems to be to satisfy the said desires.

In order to facilitate for a leaking fluid to flow out to the surrounding of the heat exchanger it is possible, as shown in FR 2 454 075, to keep the heat exchange plates in each double-wall element at a distance from each other by means of a heat conducting metal wire net inserted between the heat exchange plates. However, this means that the heat conducting contact between the heat exchange plates is deteriorated and thus that the efficiency of the heat exchanger is getting lower.

The object of the present invention is to accomplish a plate heat exchanger of the kind initially described, which has a high efficiency at the same time as it makes it possible for a leakage through a heat exchange plate to be quickly observed.

This is accomplished according to the present invention in a plate heat exchanger of the kind initially described, which is characterized by at least one channel in each double-wall element between the two heat exchange plates thereof, which channel is formed between limited parts of the sealing portions of the heat exchange plates, said parts being located just opposite each other, and which extends across the sealing portions, connecting an area inside the sealing portions to the surrounding of the plate heat exchanger, remaining parts of the sealing parts abutting directly against each other.

By means of the invention it has shown to be possible to quickly observe a leakage also without keeping the heat exchange portions of the two heat exchange plates in each double-wall element at a distance from each other. It thus seems to have been the case that the problem to be able to observe a leakage quickly in a plate heat exchanger of the kind in question not primarily has been a result of the fact that the heat exchange portions of the plates in each double-wall element has been pressed too tight in contact with each other but that the sealing portions of these plates by means of the said sealing members have been pressed against each other with such a force that a leaking fluid could have been enclosed between the plates inside the sealing portions, which have been extending without interruption around the heat exchange portions.

In a preferred embodiment of the invention a spacing member is arranged between the heat exchange plates in each double-wall element at said parts of the sealing portions of the plates.

In an alternative embodiment there is a groove formed in at least one of the heat exchange plates to form the channel.

The invention will be described in the following with reference to the accompanying drawings, in which FIG. 1 schematically shows a plate heat exchanger according to the invention with eight heat exchange plates, which are separated from each other.

Figure 2:
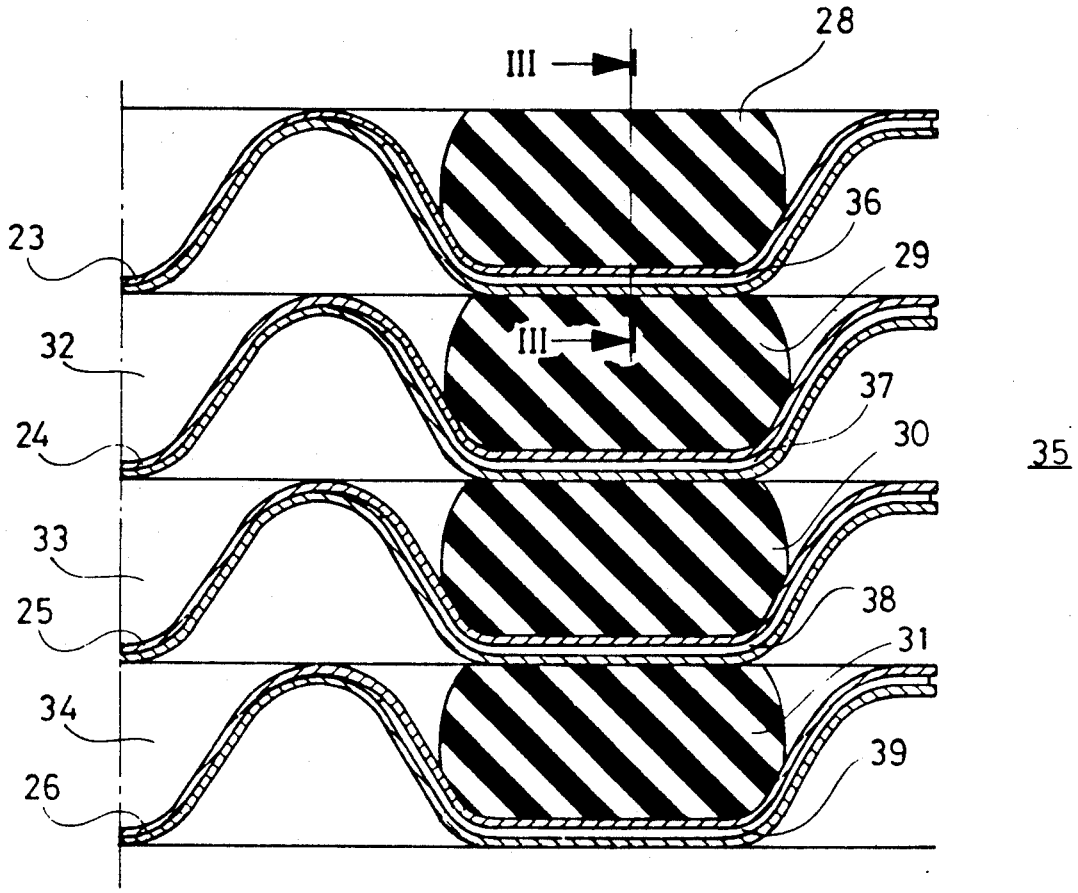

FIG. 2 schematically shows a section through some heat exchange plates in a plate heat exchanger according to the invention.

Figure 3:
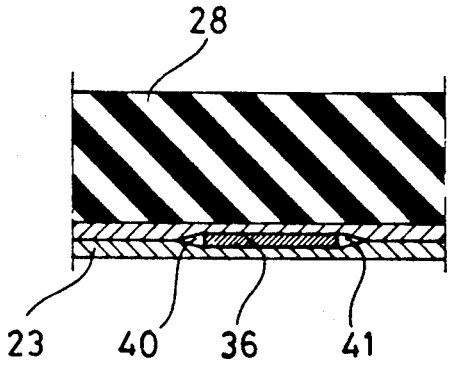
Figure 4:
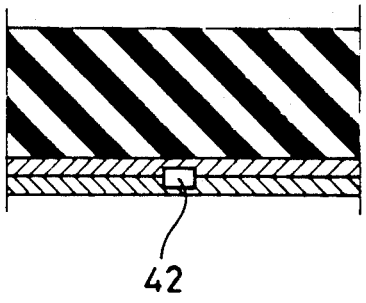

FIG. 3 shows a section through parts of two heat exchange plates along a line III—III in FIG. 2, and FIG. 4 shows a section, corresponding the one in FIG. 3, through two heat exchange plates in a plate heat exchanger according to another embodiment of the invention.

The plate heat exchanger shown in FIG. 1 has eight shown heat exchange plates 1–8, which in pairs form double-wall elements 9–12. The double-wall elements are stacked and form between themselves flow passages 13–15 for the two fluids. All the heat exchange plates 1–8 are in the shown embodiment identical and are produced from a thin plate, which by pressing has been provided with corrugations in the shape of ridges 16 and valleys 17. These ridges 16 and valleys 17 form a fish bone pattern of the respective sides of each plate in its heat exchange portion 18. Each heat exchange plate is rectangular and has in each one of its corner portions a through flow opening 19–22. Heat exchange plates, which are included in one and the same double-wall element are directed in the same manner with coinciding fish bone pattern and in front of each other located through flow openings.

Adjacent double-wall elements 9 and 10, 10 and 11, respectively, 11 and 12 are turned 180° in their respective plane relative to each other in a way such that the through flow openings are aligned up to each other in each corner portion through the stack of double-wall elements.

Further to the central heat exchange portion 18 each heat exchange plate 1–8 is provided with sealing portions. One of these sealing portions surrounds the heat exchange portion. The rest of the sealing portions surrounds the through flow openings 19–22 of the heat exchange plates. Depending on the position of the heat exchange plate in the plate heat exchanger a sealing member abuts against one or both sides of the heat exchange plates 1–8 at their sealing portions partly to make the flow passages 13–15 between the double-wall elements 9–12 tight and partly to make the passages through the flow openings 19–22 tight.

How the different heat exchange plates are intended to sealingly abut each other when they are pressed against each other has been illustrated in FIG. 1 by dotted lines. The two heat exchange plates 1 and 2, 3 and 4, 5 and 6, 7 and 8, respectively, which are included in one and the same double-wall element 9, 10, 11 and 12, respectively, are only tightened against each other around the four through flow openings 19–22. By the fact that the heat exchange plates in one and the same double-wall element are directed in the same way in the plate heat exchanger the ridges 16 of the heat exchange plate 2, for instance, will be located in the valleys on the rear side of the heat exchange plate 1, which forms the ridges 16 on the front side of the same. Hereby a large heat exchange contact surface will be created between the heat exchange plates in a double-wall element essentially over all of the surfaces of it. Any fluid will not normally flow between these heat exchange plates 1 and 2.

In the same way the plates 3 and 4, 5 and 6, 7 and 8, respectively, shall have good surface contact with each other and only be tightened against each other around the through flow openings 19–22.

Adjacent heat exchange plates, such as the heat exchange plates 2 and 3, which take part in different double-wall elements and are turned 180° in the planes of the plates relative to each other, shall together delimit a flow passage 13 for the one fluid. For this purpose these heat exchange plates are tightened to each other partly along their sealing portions, which extend around and enclose the heat exchange portions of the plates, partly around two of the through flow openings of the heat exchange plates 2 and 3. In FIG. 1 this is illustrated by a dotted line in the heat exchange plate 3, which extends around the heat exchange portion 18 and the four through flow openings 19–22, and through a dotted line, which extends around the through flow opening 21. A corresponding dotted line should be shown around the through flow opening 20 of the heat exchange plate 3, which in the shown example is through flown by the same fluid as the through flow opening 21. This through flow opening 20 is however hidden by the heat exchange plate 2 located in front of it.

In the interspace between the adjacent heat exchange plates 2 and 3 the ridges 16 of the heat exchange plate 3 will cross and abut against the ridges on the rear side of the heat exchange plate 2, which are formed in the valleys 17 on the front side of this plate 2. Between the abutting spots between these heat exchange plates 2 and 3 there is formed a flow passage 13, which communicates with the through flow openings 20 and 21 to the right in the heat exchange plate 2 (referring to FIG. 1) and with the through flow openings 19 and 22 located just in front of these in the heat exchange plate 3, while the flow passage 13 is sealed off from connection with the rest of the through flow opening in these two heat exchange plates. The heat exchange plates 6 and 7 cooperate with each other in the same manner as the heat exchange plates 2 and 3 and form a flow passage 15, which is parallel to the flow passage 13 between the heat exchange plates 2 and 3. The heat exchange plates 4 and 5 cooperate in a similar manner, but in this case the flow passage 14 between these two plates 4 and 5 communicates with the through flow openings 19 and 22 to the left in the heat exchange plate 5 (referring to FIG. 1) and with the openings 20 and 21 in the heat exchange plates 4 located just in front of these.

The through flow openings 19–22 of the heat exchange plates form passages through the plate package for two heat exchange fluids. By means of arrows there is illustrated in FIG. 1 how a first fluid F1 is conducted into the plate package via the opening 20 of the heat exchange plate 1 and returns via the opening 21 of the same plate, and how a second fluid F2 is conducted into the package via the opening 22 in the heat exchange plate 1 and returns via the opening 19 of the same plate. The fluid F1 will during operation of the plate heat exchanger, as shown, to flow through the flow passages 13 and 15 connected in parallel, while the fluid F2 will flow through the flow passage 14.

In FIG. 2 there is shown a section through parts of the four double-wall elements 23, 24, 25 and 26 of a plate heat exchanger according to the invention. The section is put across a sealing portion, which surrounds a heat exchange portion for instance at the area of a double-wall element, which has been marked in FIG. 1 and allotted the reference number 27. Along the sealing portion the double-wall elements abut against each other via sealing members 28, 29, 30, 31, respectively, which are arranged in a sealing groove in the double-wall elements and which delimit and seal off the flow passages 32, 33 and 34 from communication with the surrounding 35 of the plate heat exchanger.

To facilitate for a fluid leaking through a heat exchange plate to flow out to the surroundings of the plate heat exchanger, there is a spacing member 36–39 arranged between the heat exchange plates in the respective double-wall element 23–26 in order to create a channel 40 and 41 on each side of the same, which connects an area inside this sealing portion with the surroundings of the plate heat exchanger. In the shown example the spacing member consists of a metal tape, which is put between the heat exchange plates in the double-wall elements. The metal tape extends across the bottom of the sealing groove and up over the flanks of the sealing groove on each side thereof. How the channels 40 and 41 are formed appears from the section shown in FIG. 3 of the double-wall element 23 with the belonging sealing member 28 along the sealing groove through the metal tape 36.

Alternatively the channel can be formed by designing a groove in at least the one heat exchange plate in a double-wall element. In FIG. 4 such an embodiment is shown. The section shown in FIG. 4 corresponds to the section shown in FIG. 3 but instead of the channels shown in FIG. 3 being formed by means of a metal tape 36 a channel 42 is formed across the sealing groove. In the shown example a groove is pressed in each one of the heat exchange plates in a double-wall element in a way such that they together form a channel 42.

In the embodiment shown in FIGS. 2–4 the channel or channels are formed by means of one spacing member or one groove. Of course, there might be an arbitrary number of channels, the two heat exchange plates in each double-wall element abutting directly against each other between these channels. In the example shown in FIG. 2 the spacing members are located just in front of each other through the stack of double-wall elements. However, it is possible within the scope of the invention to arrange the spacing members or the grooves displaced relative to each other in the longitudinal direction of the sealing groove.

In the shown embodiment of the invention the pressed pattern in the heat exchange portions of the heat exchange plates is designed in the shape of ridges and valleys but of course many other designs of protuberances and depressions are possible with the scope of the present invention.

To enable an outflow of a possible leaking fluid, which is quick enough, only small dimensions of the spacing members or the grooves are necessary. In one example of a plate heat exchanger of this kind the thickness of the heat exchange plates are between 0,25–0,6 mm. It has shown that a sufficient outflow of a leaking fluid can be achieved by a metal tape having a thickness of 0,05–0,1 mm respectively with a depth of groove which is 0,04 mm. Hereby a good heat exchange surface contact can be maintained between the two heat exchange plates in a double-wall element at the same time as a possible leakage rapidly can be observed.

What is claimed is:

1. Plate heat exchanger for exchanging of heat from one fluid to another, comprising a stack of double-wall elements (9–12, 23–26), which between themselves form flow passages (13–15, 32–34) for the two fluids, and each one of which comprises two thin heat exchange plates (1–8), each having a central heat exchange portion (18) and a sealing portion surrounding the heat exchange portion and said portions abutting directly against corresponding portions of another heat exchange plate, a sealing member (28–31), which sealingly abuts against adjacent double-wall elements (9–12, 23–26) along the sealing portions of their respective heat exchange plates and delimits a flow passage (13–15, 32–34) between the double-wall elements, and joining means arranged to press the double-wall elements (9–12, 23–26) directly against each other in areas of the heat exchange portions of the respective plates, and indirectly against each other via the sealing members (28–31) in areas of the sealing portions of the heat exchange plates, characterized by at least one channel (40–42) in each double-wall element (9–12, 23–26) between the two heat exchange plates (1–8) thereof, which channel (40–42) is formed between limited parts of the sealing portions of the heat exchange plates, said parts being located just opposite each other, and which extends across the sealing portions connecting an area inside the sealing portions to the surrounding of the plate heat exchanger (35), remaining parts of the sealing portions abutting directly against each other.

2. Plate heat exchanger according to claim 1, characterized in that a spacing member (36–39) is arranged between the heat exchange plates (1–8) at said parts of their sealing portions to form said channel (40–42).

3. Plate heat exchanger according to claim 1, characterized in that a groove is formed in at least one of the heat exchange plates to form said channel (42).

4. Plate heat exchanger according to any of the preceding claims, characterized in that every heat exchange plate (1–8) has a groove pressed in its sealing portion and extending around the heat exchange portion (18), and that every sealing member (36–39) is arranged in such a groove.

* * * * *